US007760895B1

(12) United States Patent
Lehmann

(10) Patent No.: US 7,760,895 B1
(45) Date of Patent: Jul. 20, 2010

(54) VIRTUAL SOUND IMAGING LOUDSPEAKER SYSTEM

(76) Inventor: Peter H. Lehmann, 40 Camrock Dr., Rockport, ME (US) 04856

( * ) Notice: Subject to any disclaimer, the term of this patent is extended or adjusted under 35 U.S.C. 154(b) by 848 days.

(21) Appl. No.: 11/657,374

(22) Filed: Jan. 24, 2007

(51) Int. Cl.
*H04R 25/00* (2006.01)

(52) U.S. Cl. ..... 381/160; 381/387; 181/155

(58) Field of Classification Search ..... 381/160, 381/161, 162, 339, 387; 181/155, 156
See application file for complete search history.

(56) References Cited

U.S. PATENT DOCUMENTS

| | | | | |
|---|---|---|---|---|
| 2,612,234 | A | 9/1952 | Zivadinovic | |
| 2,701,025 | A | 2/1955 | Kuhl | |
| 2,710,662 | A | 6/1955 | Camras | |
| 2,896,736 | A | 7/1959 | Karlson | |
| 3,727,004 | A | 4/1973 | Bose | |
| 4,133,975 | A | 1/1979 | Barker | |
| 4,190,739 | A | 2/1980 | Torffield | |
| 4,225,010 | A | 9/1980 | Smith | |
| 4,588,042 | A | 5/1986 | Palet | |
| 5,216,209 | A | 6/1993 | Holdaway | |
| 5,485,521 | A * | 1/1996 | Yagisawa et al. | 381/160 |
| 5,532,438 | A | 7/1996 | Brown | |
| 6,603,862 | B1 * | 8/2003 | Betts | 381/160 |

FOREIGN PATENT DOCUMENTS

| | | |
|---|---|---|
| JP | 61219293 | 9/1986 |

* cited by examiner

*Primary Examiner*—Suhan Ni

(57) ABSTRACT

A loudspeaker system positioned to one side of a listener includes a closed-back tweeter supported in front of a concave reflective surface. The curvature of the surface is formed by vertical and parallel first and second sides of a rectangle wherein the first side is rotated around the second side as axis. The tweeter projects sound with hemispherical directionality away from the listener and toward the surface. Some of the sound projected by the tweeter is reflected off of the surface toward the listener at an angle of less than about 10° relative to a principal plane of the concavity. A low frequency range loudspeaker projects sound towards the listener generally at an azimuth nearly equal to that of a virtual center of radiation of the sound projected by the tweeter off of the concavity. Thereby, the listener localizes a well-defined sound image at a few meters behind the system.

20 Claims, 9 Drawing Sheets

VIRTUAL SOUND IMAGING LOUDSPEAKER SYSTEM

BACKGROUND OF INVENTION

1. Field of Invention

This invention relates generally to loudspeaker systems and more particularly to loudspeaker systems including a reflective surface to improve the spatial quality of stereo reproduction.

2. Prior Art

A direct-radiating type of loudspeaker system includes all of the loudspeakers of the system supported at the front of the cabinet of the system and radiating directly towards a preferred listening area. Sound reproduction by a direct-radiating loudspeaker system is commonly perceived as issuing from some point within the cabinet of the loudspeaker system making such reproduction seem artificial and lacking realism. The virtual stage of stereo reproduction including a pair of such loudspeaker systems thus is perceived to be located along a line connecting the pair.

The prior art has been firstly directed to a more realistic type of reproduction by a loudspeaker system compared to that of the direct-radiating type wherein the source of the sound radiated by the loudspeaker system is localized generally in the direction of but at a point in space away from the location of the loudspeaker system.

Typically stereo reproduction occurs in a small room with a volume of about 100 $m^3$. The virtual stage of stereo reproduction in the small room with a pair of direct-radiating loudspeaker systems in front of a listener is thus generally at a much shorter distance from the listener than the distance from an audience to a live performance of music. To more closely approximate the scale of the hearing of a live performance of music, the prior art has been secondly directed to making the apparent distance to the virtual stage of stereo reproduction in a small room to be greater than that which would be provided by means for stereo reproduction including direct-radiating loudspeaker systems.

U.S. Pat. No. 2,710,662 to Camras, 1955 Jun. 14 describes a technique wherein most of the sound of a loudspeaker is firstly directed to the wall of a room that a listener in the room faces or the rear wall. Furthermore, a first reflection of the sound directed to the listener is intended to establish a virtual source of the sound at a location behind the rear wall.

Some research indicates that for the virtual source of sound to be localized at an intended location by a first reflection off of the rear wall of the room, at the location of the listener, the intensity of a first reflection of a sound with respect to that of later arriving reflections must be greater by about 10 dB. In a small room with a volume of about 100 $m^3$, the ratio of distance traveled to the listener of the first reflection of the sound with respect to that of later arriving early reflections tends to be greater than one-third. Such relationship of the ratio of distance traveled will be especially the case where the distance between the loudspeaker and the rear wall is a few meters. Thus a disadvantage of the technique exemplified by U.S. Pat. No. 2,710,662 is that the intensity of the first reflection of the sound relative to that of later arriving reflections may not be sufficiently greater to establish the intended virtual location of the loudspeaker projecting the sound in the room.

Sound projected by a loudspeaker system off of a concave reflective surface to a listener and thus eliminating the listener's perception of the sound emanating from a point source of the sound from within the cabinet of the loudspeaker system is exemplified by U.S. Pat. Nos. 4,190,739 to Torffield, 1980 Feb. 26 and 5,216,209 to Holdaway, 1993 Jun. 1. An apparent additional role of the concave reflective surface according to these patents is focusing to some degree of the sound toward the listener. Neither patent refers to the formation of a virtual sound image, which only under certain conditions accompanies the reflection of sound by a concave reflective surface. As the location of the virtual sound image occurs behind the concave reflective surface, such formation would increase the apparent distance to the source of the sound.

A first embodiment of U.S. Pat. No. 4,190,739 to Torffield includes a partly or entirely roughened concave reflective surface. The roughening is intended to partially diffuse high frequency sound reflected by the reflective surface of this first embodiment. Such partial diffusing largely negates the formation of a virtual sound image of the high frequency sound. A second embodiment of this patent includes placement of the center of radiation of a loudspeaker coincident with the focal point of the concave reflective surface that the loudspeaker system projects sound toward. Such placement negates the formation of a virtual sound image, as the propagation of the sound reflected off of the reflective surface is then parallel to the principal axis of the reflective surface.

U.S. Pat. No. 5,216,209 to Holdaway teaches that a loudspeaker should be positioned at a distance from the vertex of a concave reflective surface that the loudspeaker projects sound toward causing the sound rays emanating from the reflective surface to diverge from the principal axis of the concavity of the surface. Given the occurrence of such divergence, then a virtual sound image is formed. The location of the virtual sound image should be at a distance behind the reflective surface equal to a few meters for the distance to the image to be perceptible to a listener. This patent does not teach the relationship between the curvature of the concavity of the reflective surface and the distance of the center of radiation of the loudspeaker to the vertex of that curvature affecting the distance of the virtual image behind the reflective surface.

U.S. Pat. No. 4,190,739 to Torffield states that the reflective surface of a reflector according to this patent can possibly be a concavity both horizontally and vertically. However, this patent does not teach the conditions under which a concavity horizontally or vertically might be eliminated nor does this patent refer to an embodiment not including a reflective surface with a concavity both vertically and horizontally. U.S. Pat. No. 5,216,209 to Holdaway stipulates that the reflective surface according to this patent includes a concavity both horizontally and vertically. The reflective surface of a reflector including a concavity both horizontally and vertically presents greater difficulties and thus expense in the manufacturing of the reflective surface than a reflective surface that can be flat in one direction.

U.S. Pat. No. 4,190,739 to Torffield proposes a reflector with a reflective surface area between 5 to 8 feet square for use in a listening room in a home. The reflector according to this patent can be positioned orthogonal with respect to the direction of and to one side of a listener facing forward. For a listening room with a volume of about 100 $m^3$ for example in a home, to save space, his reflector would be best attached to a wall of the listening room. His reflector with a concavity both horizontally and vertically, however, in all likelihood would be of a weight requiring extraordinary means for securely attaching it to the wall.

According to U.S. Pat. No. 5,216,209 to Holdaway, for a room of standard size in a home, the reflector screen of this patent can measure about 48 inches in width. The curvature of Holdaway's reflector screen horizontally is symmetrical with respect to a central axis and loudspeakers radiating toward the screen are positioned close to the central axis. The propagation of sound reflected from his screen, then, is generally in the direction of the central axis of the concavity of the screen. Thus, for the purpose of reflecting sound toward a listener generally near the middle of the room, his screen must be horizontally positioned obliquely in the room. The size and oblique positioning of his reflector screen may result in his screen occupying such a substantial percentage of the floor area of the room as to be impractical or unappealing.

ADVANTAGES

Accordingly, my loudspeaker system may have one or more of the following advantages.

A first advantage is a method and apparatus for stereo reproduction providing a virtual stage of the reproduction at a distance of a few meters behind a pair of loudspeaker systems of the apparatus positioned in front and on opposite sides of the listener.

A second advantage is a method and apparatus for stereo reproduction in a room wherein to a high degree the spacing of a loudspeaker system of the apparatus from the walls of the room doesn't affect the quality of the reproduction.

A third advantage is a method and apparatus for stereo reproduction in a room including an ambience effect without degrading the ability of a listener in the room to distinctly localize apparent sources of the reproduction.

A fourth advantage is a method and apparatus for stereo reproduction including a reflector with a reflective surface that is concave horizontally and flat vertically thereby resulting in less costly manufacture of the reflector.

A fifth advantage is a method and apparatus for stereo reproduction including a reflector with a reflective surface area that can be small enough to be mounted on or integrated into the cabinet of a loudspeaker system that isn't excessively large or heavy.

Additional advantages of my loudspeaker system will be made apparent from an examination of the subsequent drawings and description.

SUMMARY

Frontally and to one side of a listener in a room, a high frequency range loudspeaker or tweeter projects sound toward a horizontally concave reflective surface of a reflector and the interior boundaries of the room and away from the listener. A portion of the sound projected by the tweeter is reflected off of the reflective surface toward the listener and the spacing of the tweeter from the reflective surface causes the listener to localize the apparent source of the high frequency range sound at a distance of a few meters behind the reflective surface. A low frequency range loudspeaker projects sound generally towards the listener at an azimuth nearly equal to that of a virtual source of the sound projected by the tweeter off of the reflective surface toward the listener.

DRAWINGS

Figures—Preferred Embodiment

Figure 1:
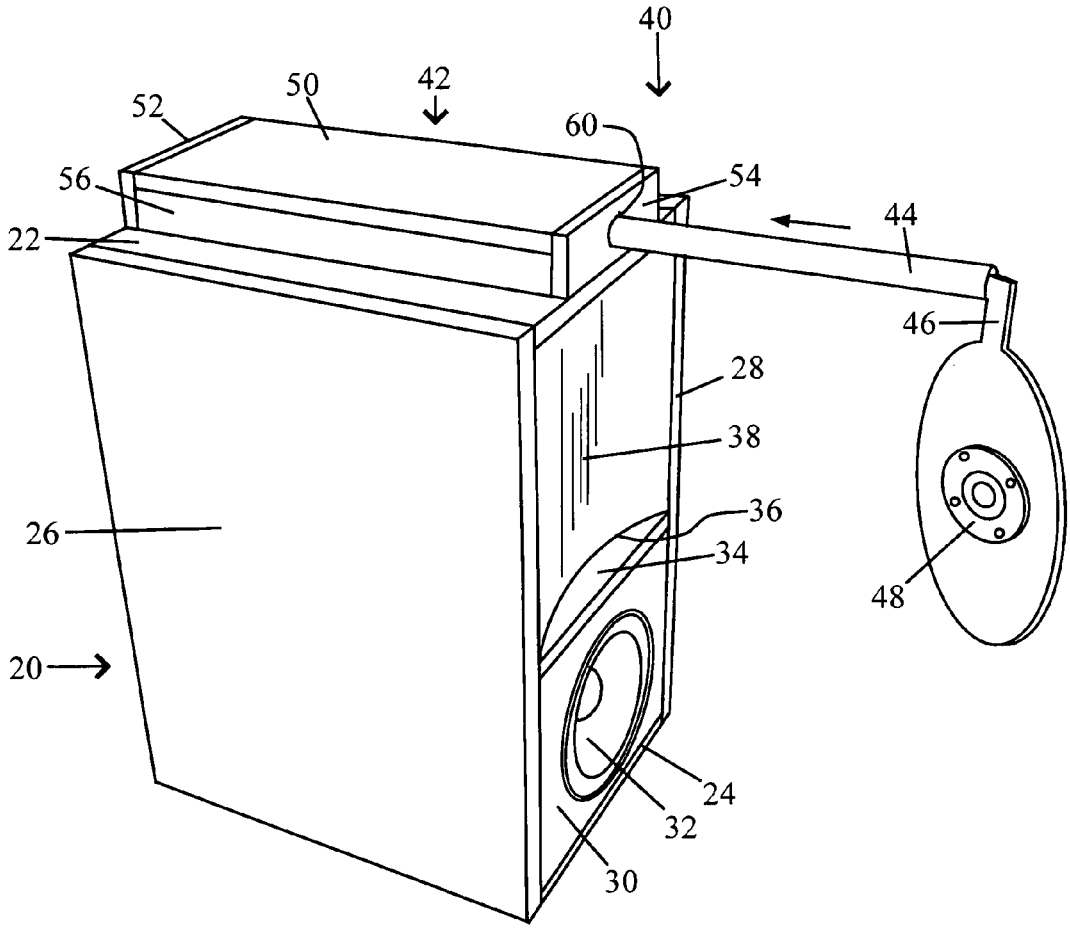
FIG. 1 is a perspective view of my loudspeaker system.
Figure 10:
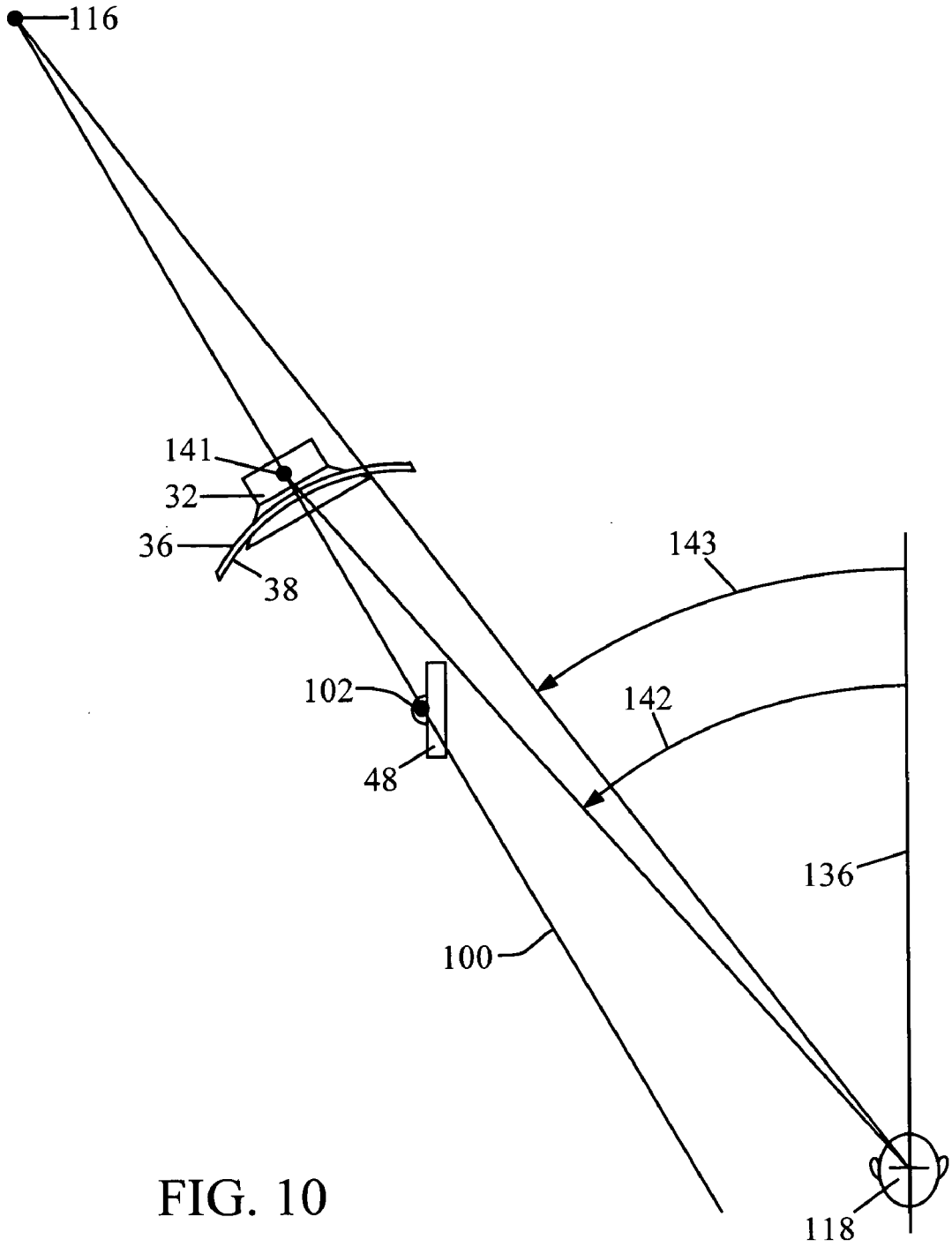

FIG. 10, not to scale, graphically represents a preferred relationship between the relative locations of the apparent sources of sound horizontally of a low frequency range loudspeaker of the loudspeaker system of FIG. 1 and the tweeter.

Figure 11:
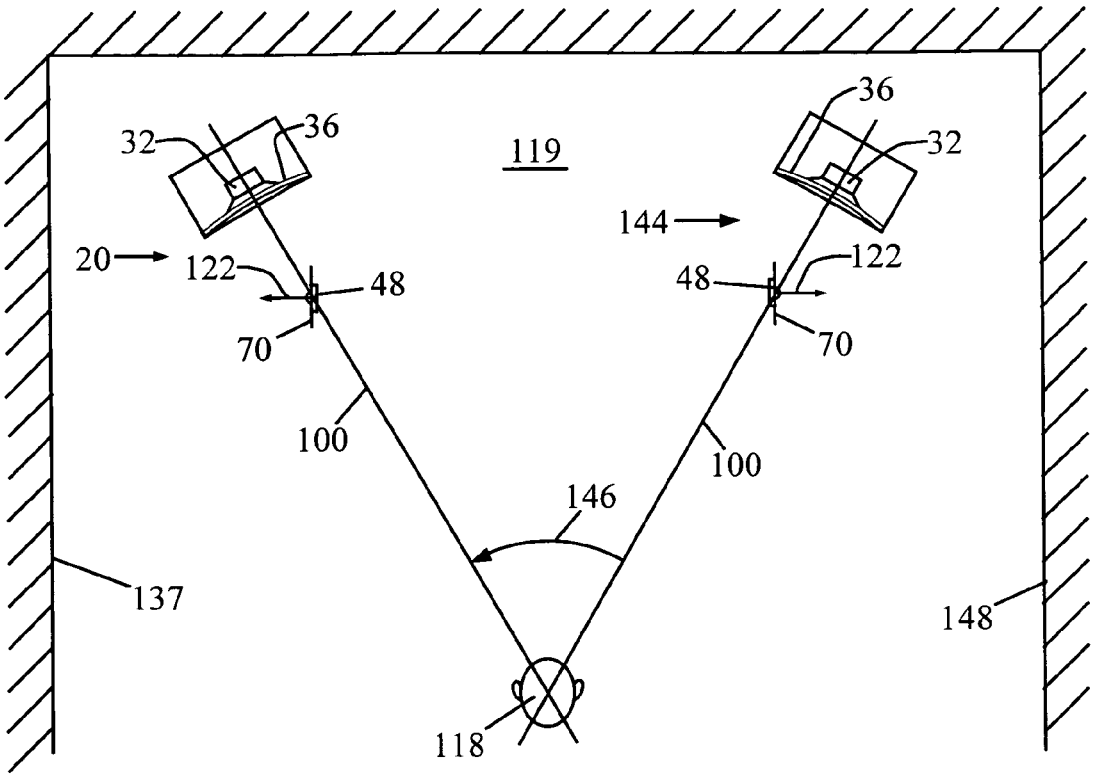

FIG. 11 is a plan view of a pair of my loudspeaker systems and a listener in a room arranged for stereo reproduction.

DRAWINGS- REFERENCE NUMERALS

| | | | |
|---|---|---|---|
| 20 | left-cornered loudspeaker system | 22 | top panel |
| 24 | bottom panel | 26 | left side panel |
| 28 | right side panel | 30 | front panel |
| 32 | low frequency range loudspeaker | 34 | partitioning panel |
| 36 | reflector | 38 | concave reflective surface |
| 40 | retractable spacing mechanism | 42 | guiding assembly housing |
| 44 | sliding arm | 46 | mounting extension |
| 48 | closed-back tweeter | 50 | upper panel |
| 52 | end-stopping block | 54 | front covering block |
| 56 | first side member | 58 | second side member |
| 60 | entry hole | 62 | aperture |
| 64 | height | 66 | horizontal finger |
| 68 | vertical finger | 70 | baffle |
| 72 | major axis | 74 | minor axis |
| 76 | tweeter mounting hole | 78 | cabinet access hole |
| 80 | first conduit clamp | 82 | second conduit clamp |
| 84 | inner flat surface | 86 | stabilizing plate |
| 88 | wiring exit hole | 90 | directional line |
| 92 | right side edge | 94 | radius center |
| 96 | vertex | 100 | principal plane |
| 102 | first center of radiation | 104 | first incident sound ray |
| 106 | second incident sound ray | 108 | first reflected sound ray |
| 110 | second reflected sound ray | 112 | first virtual ray |
| 114 | second virtual ray | 116 | virtual center of radiation |
| 118 | listener | 119 | room |
| 120 | left side edge | 122 | radiation axis |
| 124 | first sound ray | 126 | second sound ray |
| 128 | first angle | 130 | second angle |
| 132 | third sound ray | 134 | third angle |
| 136 | mid-sagittal plane | 137 | left side wall |
| 138 | rear wall | 139 | fourth angle |
| 140 | base line | 141 | second center of radiation |
| 142 | fifth angle | 143 | sixth angle |
| 144 | right-cornered loudspeaker system | 146 | seventh angle |
| 148 | right side wall | I | virtual source distance |
| O | source distance | R | radius of curvature |
| L | distance to listener | | |

DESCRIPTION

FIG. 1

FIG. 1 shows a perspective view of a two-way type of embodiment of my loudspeaker system for reproducing the left channel of an input sound signal in a room. A two-way loudspeaker system includes first and second loudspeakers reproducing respectively upper and lower frequency bands that together comprise most of the audio frequency spectrum and overlap to a greater or lesser degree at frequencies approaching a crossover frequency.

Shown at FIG. 1, a cabinet of left-cornered loudspeaker system 20 includes a top panel 22, a bottom panel 24, a left side panel 26, a right side panel 28, and a front panel 30 supporting low frequency range loudspeaker 32. The cabinet also has a rear panel (not shown). A partitioning panel 34 is at a right angle to front panel 30 and forms the upper wall of an enclosure (not shown) for containing sound projected by and rearward of the low frequency range loudspeaker. A reflector 36 with a horizontally concave reflective surface 38 is positioned in a front rectangular opening of the cabinet between the left side and right side panels, and between the partitioning panel and top panel.

Figure 4:
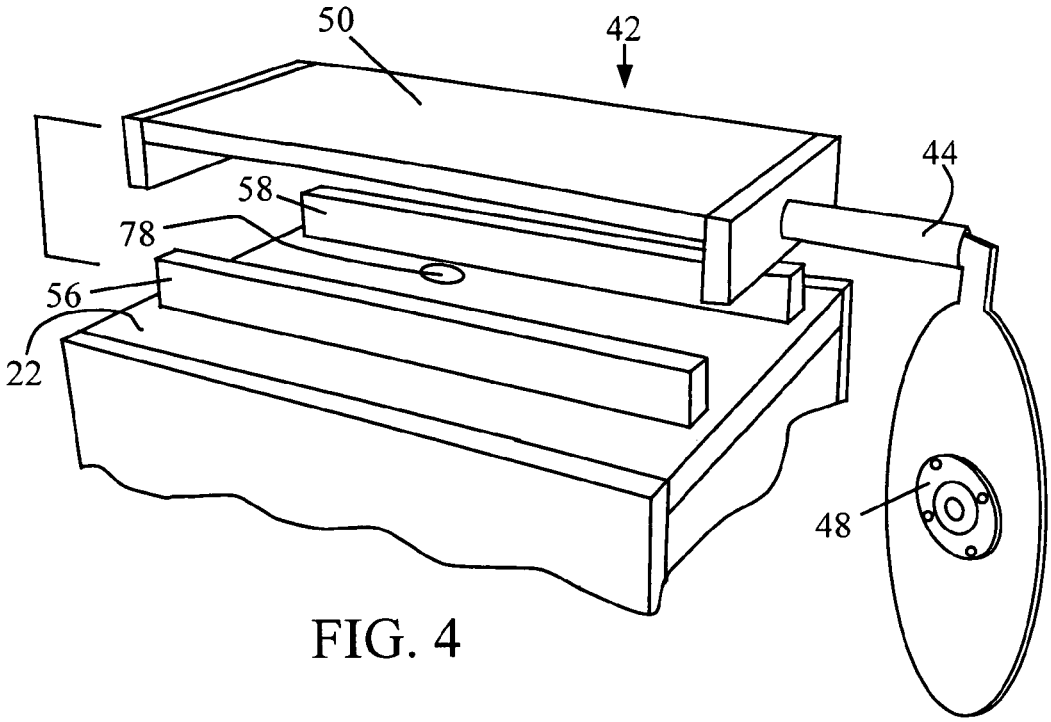
FIG. 4 is an exploded perspective view of the structure for supporting the tweeter of the loudspeaker system of FIG. 1.
Figure 5:
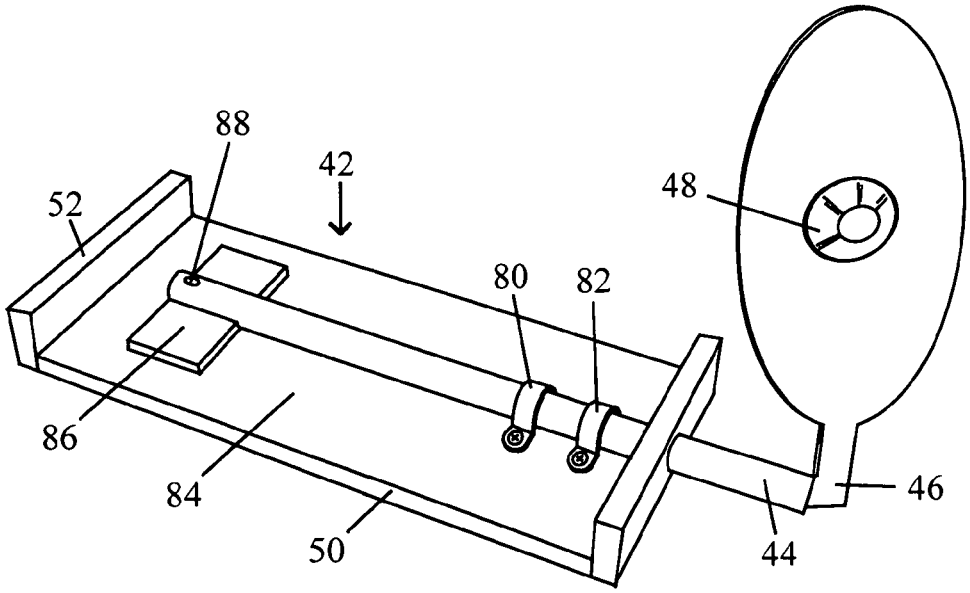
FIG. 5 shows the structure of FIG. 4 rotated 180 degrees.

A retractable spacing mechanism 40 includes a guiding assembly housing 42, a sliding arm 44 and a mounting extension 46 attached to a first end of the tubular sliding arm and supporting a high frequency range loudspeaker that is closed-back tweeter 48. The tweeter is of the omni-directional type and the front of the tweeter or the side that sound is projected from is shown. The tweeter is supported and oriented by the mounting extension to cause some of the sound projected by the tweeter to be directed towards concave reflective surface 38 of reflector 36. The guiding assembly housing includes an upper panel 50, an end-stopping block 52 and a front covering block 54. The end-stopping and front covering blocks are permanently attached to respectively rear and front ends of the upper panel at right angles thereto. The guiding assembly housing is fastened to a first side member 56 and a second side member 58. Second side member 58, not shown at FIG. 1, is shown at FIG. 4. Both side members are affixed in parallel to top panel 22 of the cabinet of left-cornered loudspeaker system 20. An entry hole 60 is provided in the front covering block allowing the sliding arm to travel in the interior of the guiding assembly housing.

Low frequency range loudspeaker 32 is supported laterally in the middle of front panel 30 and the vertex of the concavity of concave reflective surface 38 of reflector 36 is in the middle laterally of the front opening of left-cornered loudspeaker system 20 between left side panel 26 and right side panel 28. Thereby, the center of radiation (not shown) of low frequency range loudspeaker 32 substantially lies on a vertical plane that is normal to the concave reflective surface at the vertex of the surface's concavity. The center of radiation of a loudspeaker is the point in space that a loudspeaker with a cone or dome type of radiator apparently projects sound from. The center of radiation can be considered to be located at the center of the voice coil of electro-dynamic moving coil loudspeakers.

The concave reflective surface 38 of reflector 36 is nearly of the identical width and height as the rectangular opening with a perimeter composed of left side panel 26, right side panel 28, top panel 22, and partitioning panel 34. The concave reflective surface filling the opening reduces diffraction of sound radiated by closed-back tweeter 48 toward the periphery of the concave reflective surface.

Given the frequency of the input sound signal to the left-cornered loudspeaker system 20 approaching the crossover frequency of the system, then the input sound signal is reproduced simultaneously by low frequency range loudspeaker 32 and closed-back tweeter 48. Such simultaneous reproduction results in interference between sounds projected by the low frequency range loudspeaker and by the tweeter off of concave reflective surface 38 of reflector 36 toward the listener. Minimizing the distance between the low frequency range loudspeaker and the geometric center of the concave reflective surface is preferable to reduce the complexity of such interference. That is, as shown at FIG. 1, the reflector is preferably located directly above the low frequency range loudspeaker.

Retractable spacing mechanism 40 is mounted on top panel 22 in such a manner that the center of radiation (not shown) of tweeter 36 is coincident with a line normal to the concave reflective surface 38 at the maximum concavity of the reflective surface and equidistant from the top and bottom edges of the concave reflective surface. Sliding arm 44 is shown fully extended as required when left-cornered loudspeaker system 20 is in use. The sliding arm can be retracted in the direction of the arrow adjacent to the sliding arm so that the retractable spacing mechanism and mounting extension 46 are less of an obstruction when the loudspeaker system is not in use, stored or packaged for shipment.

DESCRIPTION

FIG. 2

Figure 2:
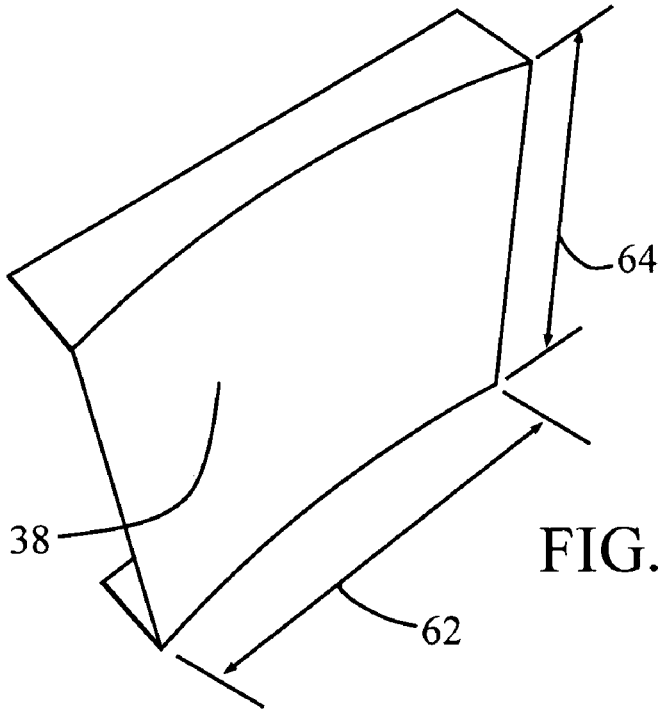
FIG. 2 is a perspective view of a sound mirror or reflector of the loudspeaker system of FIG. 1.

Shown at FIG. 2 is reflector 36 of FIG. 1. The concavity of concave reflective surface 38 is formed by vertical and parallel first and second sides of a rectangle wherein the first side is rotated around the second side as axis. An aperture 62 is the straight-line distance from the beginning to the end of the concavity of the concave reflective surface on a plane perpendicular to the vertical second side of the rectangle. So that the reflective surface can efficiently reflect sound of a frequency within the frequency range of operation of closed-back tweeter 48 of FIG. 1, the aperture is made equal to about 1.5 times the wavelength of the crossover frequency of the left-cornered loudspeaker system 20 of FIG. 1 or 2 kHz. The height 64 of the reflective surface is made about equal to the aperture.

Concave reflective surface 38 can be constructed of a variety of materials of a low absorption coefficient for sound in the frequency range of about 1 kHz to 20 kHz and of sufficient rigidity. Such materials may include rolled aluminum or steel or alternately vacuum formed or injection-molded plastic. One or more flanges provided along the edges of reflector 36 may be used to fasten it to inner surfaces of top panel 22, left side panel 26, right side panel 28, and partitioning panel 34 forming the rectangular opening at the front of left-cornered loudspeaker system 20 of FIG. 1.

DESCRIPTION

FIG. 3

Figure 3:
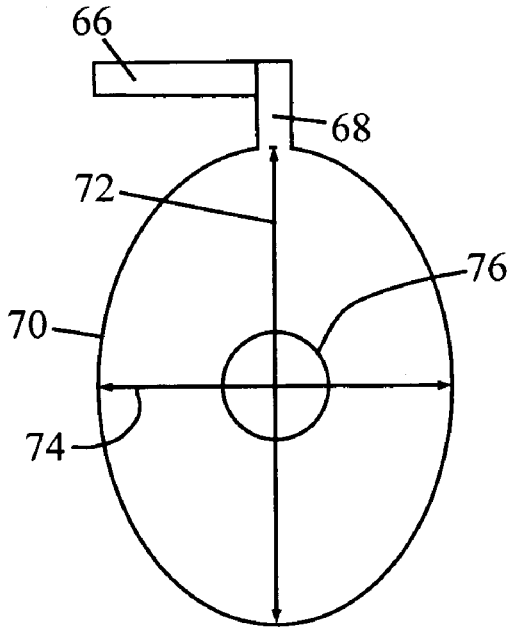
FIG. 3 is an orthogonal side view of the baffle and joining or attaching fingers that a tweeter is attached to and is part of the structure for supporting the tweeter of the loudspeaker system of FIG. 1.

Shown at FIG. 3 is an orthogonal side view of mounting extension 46 of FIG. 1. Constructed of 3 mm or $1/8^{th}$ inch thick sheet aluminum, the mounting extension has a horizontal finger 66, a vertical finger 68 and a baffle 70. The horizontal finger is inserted into and attached to the hollow interior of the first end of sliding arm 44 of FIG. 1. A vertical major axis 72 and a horizontal minor axis 74 of the elliptical perimeter of the baffle measure in length respectively 28 cm or 11 inches and 17 cm or 6.5 inches. The radius center of a tweeter-mounting hole 76 for attaching and supporting closed-back tweeter 48 of FIG. 1 is located at the intersection of the major and minor axes.

DESCRIPTION

FIG. 4

FIG. 4 shows retractable spacing mechanism 40 and closed-back tweeter 48 of FIG. 1 in a broken perspective view of the top of left-cornered loudspeaker system 20 of FIG. 1. At FIG. 4 guiding assembly housing 42 is shown separated from being fastened to top panel 22 in an exploded view. Sliding arm 44 is shown partially retracted.

Guiding assembly housing 42 is attached to top panel 22 by joining upper panel 50 to first side member 56 and second side member 58. A cabinet access hole 78 is of such a diameter that wiring (not shown) connecting closed-back tweeter 48 to an associated network or connecting terminals (not shown) of left-cornered loudspeaker system 20 of FIG. 1 through the interior of sliding arm 44 can pass freely into the interior of the cabinet of the left-cornered loudspeaker system.

DESCRIPTION

FIG. 5

The retractable spacing mechanism 40 supporting closed-back tweeter 48 shown at FIG. 4 is shown here with guiding assembly housing 42 rotated 180° along the length of partially retracted sliding arm 44.

A first plastic (electrical) conduit clamp 80 and a second plastic (electrical) conduit clamp 82 restrict tubular sliding arm 44 to a position very nearly flat against an inner flat surface 84 of upper panel 50. The two clamps also restrict travel of the sliding arm to a direction parallel with the lateral edges of the upper panel.

Sliding arm 44 is a length of /1;2 inch plastic electrical conduit. A recess is cut into a second end of the sliding arm opposite to the first end of the sliding arm attached to mounting extension 46. The depth of the recess is equal to the thickness of a stabilizing plate 86 and the plate is fastened into the recess without obstructing an open area between the side of the stabilizing plate facing the recess and the inner concavity of the sliding arm. The stabilizing plate held against inner flat surface 84 of upper panel 50 by the sliding arm prevents rotation of the sliding arm.

When sliding arm 44 is fully extended, then stabilizing plate 86 is against first conduit clamp 80. In a retracted state, the second end of the sliding arm to which the stabilizing plate is attached is against end stopping block 52. A wiring exit hole 88 allows wiring (not shown) connected to closed-back tweeter 48 passing through the hollow sliding arm to enter the interior of guiding assembly housing 42 for routing through cabinet access hole 78 shown at FIG. 4.

DESCRIPTION

FIG. 6

Figure 6:
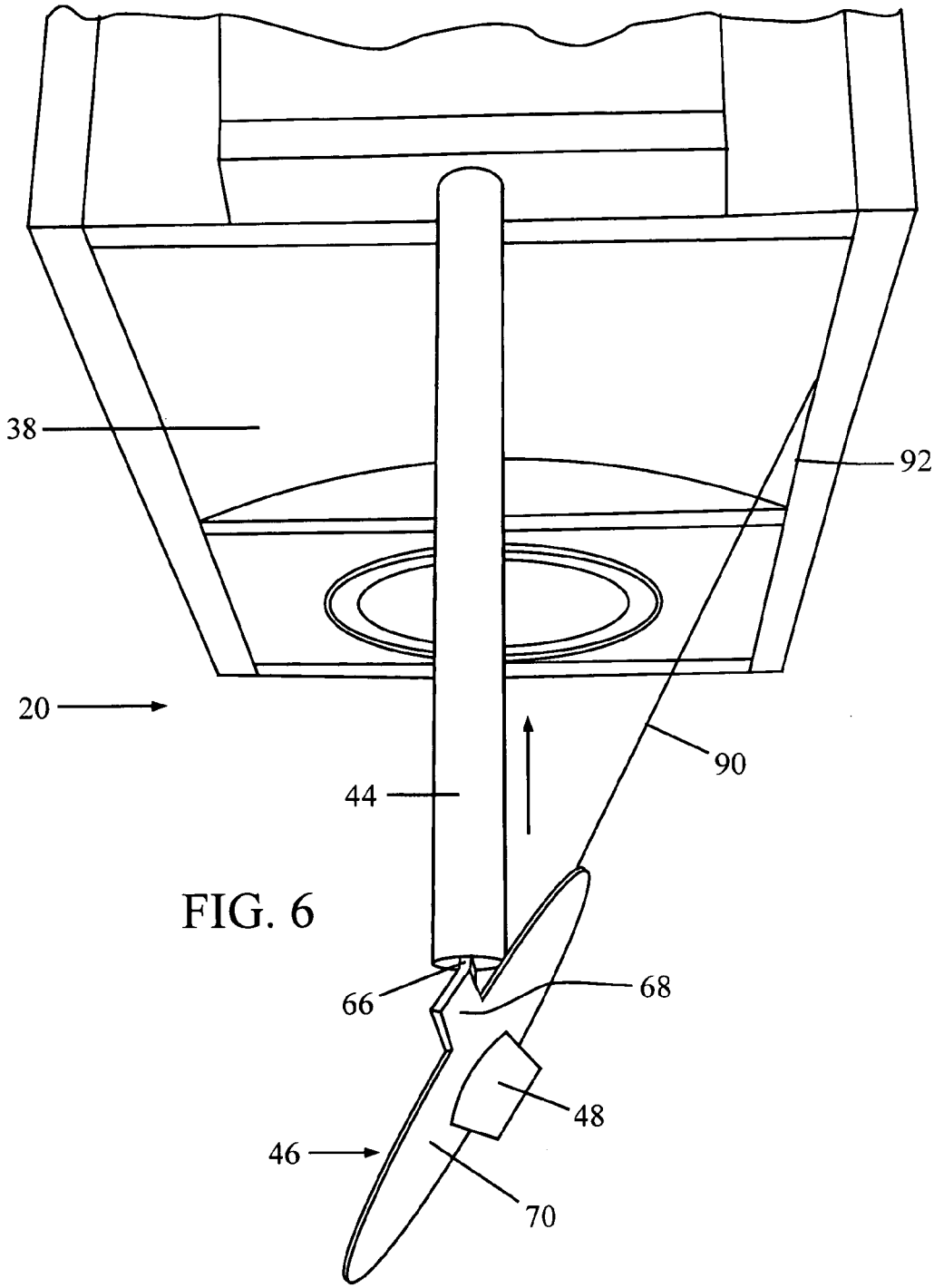
FIG. 6 is a broken view of the loudspeaker system of FIG. 1 in perspective shown from a point of view in front of the loudspeaker system.

FIG. 6 is a broken perspective view from above of the front of left-cornered loudspeaker system 20 of FIG. 1. Only the rear side of closed-back tweeter 48 is visible. Sliding arm 44 is shown fully extended and positioning the tweeter for correct operating of the loudspeaker system. The arrow adjacent to the sliding arm points in the direction of retracting the sliding arm.

In an orthogonal top view, horizontal finger 66 of mounting extension 46 is attached to sliding arm 44 in a manner causing the center of radiation (not shown) of closed-back tweeter 48 to lie on a vertical plane (not shown) coincident with the vertex and normal to the concavity of concave reflective surface 38. A directional line 90 substantially intersects with the center of radiation of the closed-back tweeter and a right side edge 92 of the concave reflective surface. Both the tweeter and vertical finger 68 are fixedly attached to baffle 70. The bending angle of the vertical finger with respect to the horizontal finger is such that the directional line lies flat on the surface of the side of the baffle facing the front of the closed-back tweeter.

Figure 7:
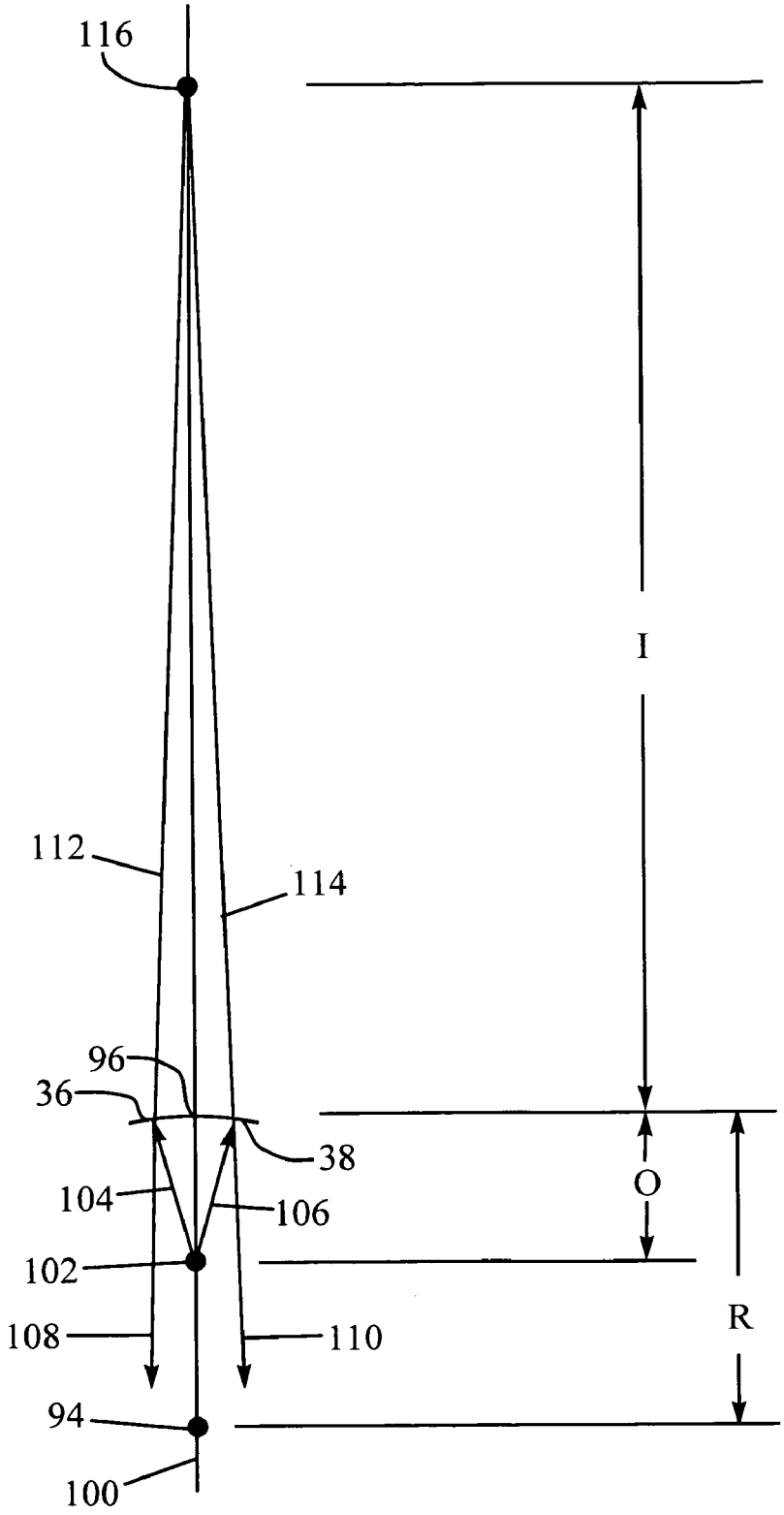
FIG. 7 is a graphical representation to scale of virtual sound imaging by the loudspeaker system of FIG. 1.

DESCRIPTION FIG. 7—To Scale

FIG. 7 diagrammatically shows application of the mirror equation of optics to my method for producing a virtual sound image by the left-cornered loudspeaker system 20 of FIG. 1. FIG. 7 is drawn to scale to communicate visually the result of calculations according to the mirror equation. Concave reflective surface 38 of reflector 36 of FIG. 2 is graphically represented here in an orthogonal top view.

Concave reflective surface 38 is formed by vertical and parallel first and second sides of a rectangle wherein the first side is rotated around the second side as axis located at a radius center 94. The second side of the rectangle stopped at the middle of its rotation is a vertex 96 of the concave reflective surface. A principal plane 100 is the vertical plane coincident with the plane of the rectangle including the first side of the rectangle stopped at the middle of its rotation.

A first center of radiation 102 of closed-back tweeter 48 (not shown) of FIG. 1 is coincident with principal plane 100 and with respect to vertex 96 at about half the distance to radius center 94 but closer to the vertex. A first incident sound ray 104 and a second incident sound ray 106 strike concave reflective surface 38. Corresponding to the first and second incident sound rays are respectively a first reflected sound ray 108 and a second reflected sound ray 110. Both first and second reflected sound rays diverge from being parallel to the principal plane by less than about 10°.

Extensions of first reflected sound ray 108 and second reflected sound ray 110 behind concave reflective surface 38 are respectively a first virtual ray 112 and a second virtual ray 114. The first and second virtual rays converge to being coincident with principal plane 100 at a virtual center of radiation 116. A source distance O equals the distance from vertex 96 to first center of radiation 102. A virtual source distance I equals the distance from the vertex to the virtual center of radiation. A radius of curvature R equals the distance from the vertex to radius center 94.

DESCRIPTION

Figure 8:
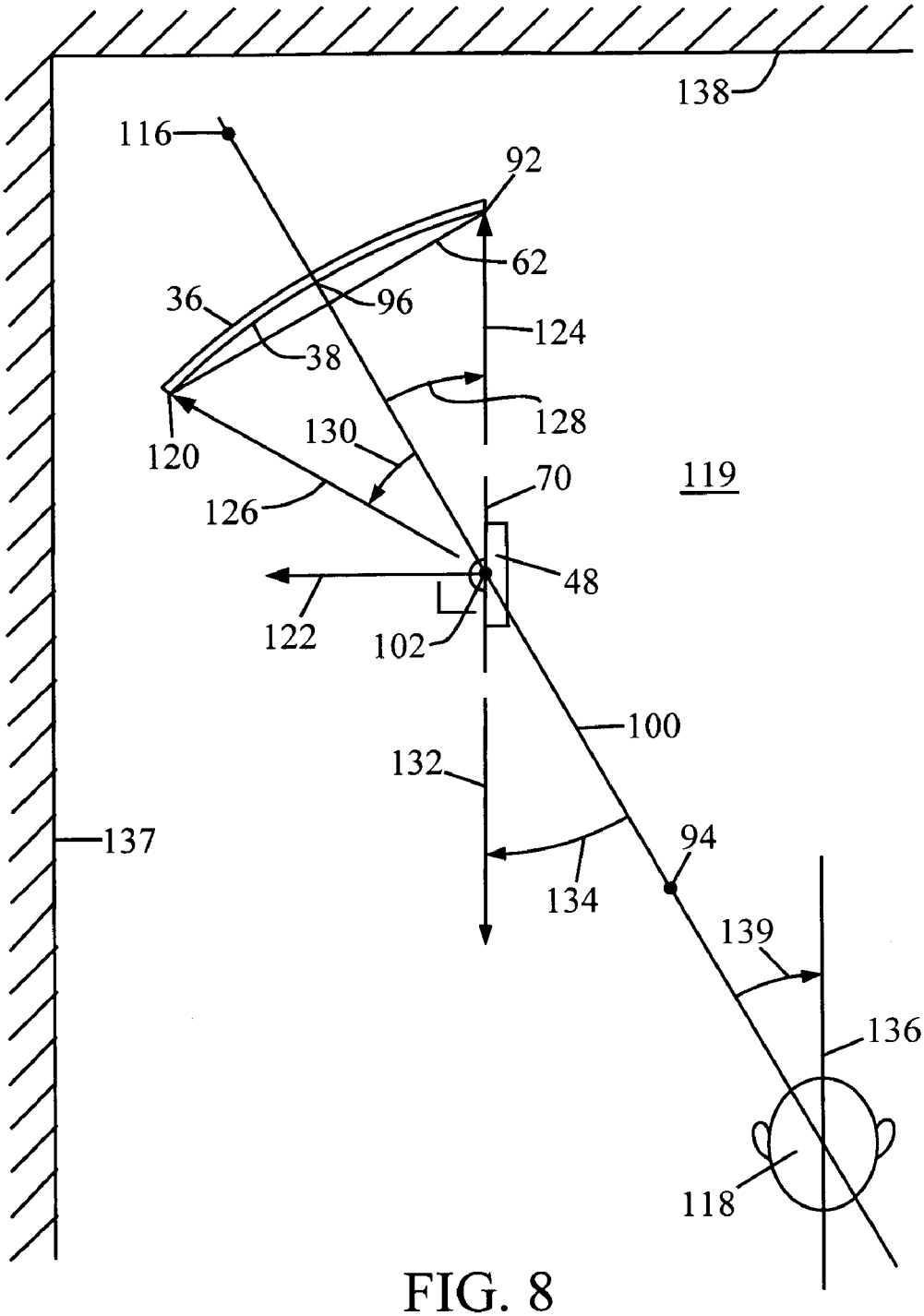
FIG. 8 is representative in an orthogonal top view not to scale of the tweeter and reflector of the loudspeaker system of FIG. 1 conventionally positioned in a room with a listener.

FIG. 8—Not to Scale

In an orthogonal top view, FIG. 8 diagrammatically represents reflector 36, closed-back tweeter 48 of left-cornered loudspeaker system 20 of FIG. 1 and a listener 118 in a room 119. Aperture 62 is of the straight-line distance equal to 25.4 cm. Height 64 (shown only at FIG. 2) of the concave reflective surface 38 also equals 25.4 cm.

The ratio of focal length (not shown) of concave reflective surface 38 with respect to aperture 62 is made equal to 1.2. As the distance from vertex 96 to radius center 94 equals the radius of curvature of the reflective surface and is twice the focal length, this distance is 2.4 times the aperture. The maximum concavity of the reflective surface at the vertex equals about 1.3 cm or 0.5 inches.

First center of radiation 102 of closed-back tweeter 48 is coincident with principal plane 100. With respect to vertex 96, the first center of radiation is at a distance of 4.0 cm less than the focal length of 30.5 cm. Virtual center of radiation 116 lies on the principal plane at a distance behind concave reflective surface 38 that is about two-thirds times the distance that listener 118 is in front of the concave reflective surface, such relationship of distances not being shown at FIG. 8.

A radiation axis 122 is the axis that sound projected from closed-back tweeter 48 progresses along symmetrically at an azimuth of 90° with respect to the flat surface of baffle 70 supporting the closed-back tweeter. A first sound ray 124 emanates from the tweeter at a −90° angle with respect to the radiation axis. The azimuth of the radiation axis with respect to principal plane 100 causes the first sound ray to strike right side edge 92 of concave reflective surface 38. A second sound ray 126 also emanating from the tweeter strikes a left side edge 120 of the concave reflective surface. Thereby sound is projected by the tweeter off of all of the concavity of the concave reflective surface The distance from vertex 96 to first center of radiation 102 equal to 26.5 cm is slightly greater than aperture 62 equal to 25.4 cm and the principal plane bisects the aperture. A first angle 128 and a second angle 130 are the azimuths of respectively the first and second sound rays with respect to the principal plane. Thus the first and second angles equal respectively about −27° and 27°. A third sound ray 132 emanates from the tweeter at a 90° azimuth with respect to first axis of radiation 122. Thus a third angle 134 that is the azimuth of the third sound ray with respect to the principal plane equals that of the first angle or −27°.

Listener 118 is positioned in room 119 conforming to a standard way of arranging the position of a listener and a left-cornered loudspeaker system in a room for stereo reproduction. Positioned laterally near the center of the room, listener 118 is 3 m or 9.8 ft. distant from vertex 96. A mid-sagittal plane 136 of the listener is perpendicular to a rear wall 138 of the room.

A fourth angle 139 is the azimuth of mid-sagittal plane 136 with respect to principal plane 100. Reflector 36 fixedly attached to the cabinet of loudspeaker system 20 of FIG. 1 is oriented near a left side wall 137 of room 119 causing the fourth angle to be equal to about −30°. Thus listener 118 hears left channel high frequency range sound reflected by concave reflective surface 38 toward the listener at an azimuth of about 30° relative to the direction of the listener facing directly forward.

DESCRIPTION

Figure 9:
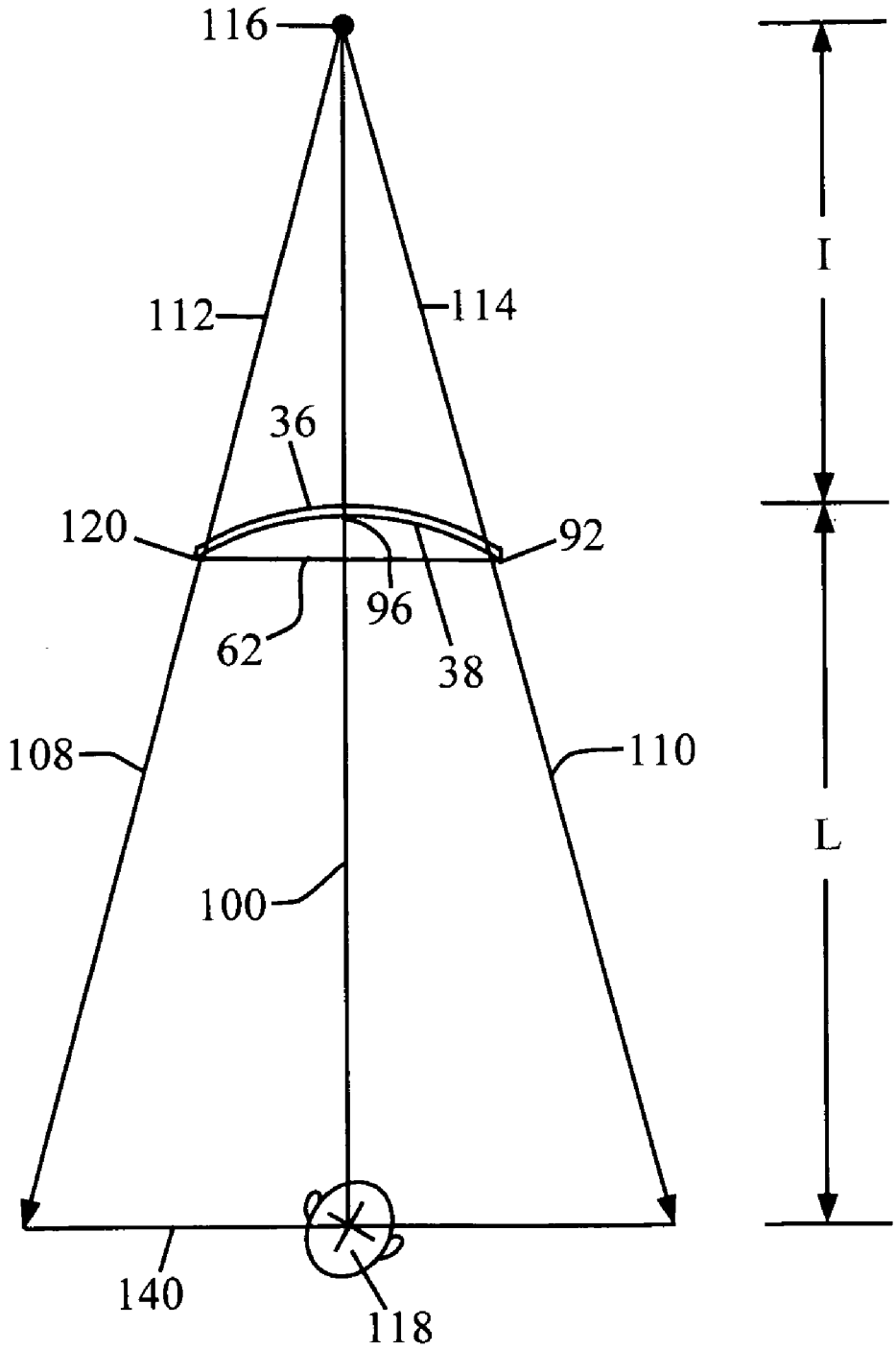
FIG. 9 is graphical representation in an orthogonal top view not to scale of focusing of the sound reflected by the concave reflective surface of the reflector of the loudspeaker system of FIG. 1.

FIG. 9—Not to Scale

FIG. 9 diagrammatically represents focusing of high frequency range sound by concave reflective surface 38 of reflector 36 affecting the maximum distance that listener 118 can be positioned to one side of principal plane 100.

First reflected sound ray 108 and second reflected sound ray 110 represent the reflection of some of the sound projected by closed-back tweeter 48 (not shown) off of concave reflective surface 38. The first and second reflected sound rays originate along the concave reflective surface near respectively left side edge 120 and right side edge 92 of the surface. Thus the straight-line distance perpendicular to principal plane 100 between the points of the first and second reflected sound rays leaving the concave reflective surface very nearly equals the magnitude of aperture 62.

First virtual ray 112 and second virtual ray 114 are extensions behind the concave reflective surface of respectively the first and second reflected sound rays. The first and second virtual rays are coincident with principal plane 100 at virtual center of radiation 116. The first and second reflected sound rays are shown terminating at a base line 140. The base line is perpendicular to the principal plane and is coincident with the center of the head of listener 118.

The center of the head of listener 118 is coincident with principal plane 100 and the listener faces forward at a −30° angle with respect to the principal plane. A distance to listener L is the distance along the principal plane from the center of the listener's head to vertex 96 of concave reflective surface 38. Virtual source distance I is the distance along the principal plane of virtual center of radiation 116 from the vertex.

DESCRIPTION

FIG. 10—Not to Scale

FIG. 10 is a representational diagram in an orthogonal top view. Concave reflective surface 38 of reflector 36 has principal plane 100. First center of radiation 102 of tweeter 48 coincident with the principal plane results in virtual center of radiation 116 also coincident with the principal plane. A second center of radiation 141 of low frequency range loudspeaker 32, according to the method of my loudspeaker system, is coincident with the principal plane.

Listener 118 is positioned to receive sound projected by tweeter 48 off of concave reflective surface 38, but the listener is shown displaced from his/her preferred location coincident with principal plane 100. Such displacement is shown for demonstrating one aspect of the method of my loudspeaker system. A fifth angle 142 is the azimuth of a first line coincident with the center of the listener's head and second center of radiation 141 with respect to mid-sagittal plane 136. A sixth angle 143 is the azimuth of a second line coincident with the center of the listener's head and virtual center of radiation 116.

DESCRIPTION

FIG. 11

Shown at FIG. 11 is a plan view of left-cornered loudspeaker system 20 of FIG. 1 for reproducing left channel sound only and a right-cornered loudspeaker system 144 for reproducing right channel sound only. The right-cornered loudspeaker system is a mirror image of the left-cornered loudspeaker system. Each of the pair of loudspeaker systems has the identical components, low frequency range loudspeaker 32, reflector 36 and closed-back tweeter 48. Retractable spacing mechanism 40, shown at FIG. 4, of each of the pair of loudspeaker systems is not shown here for clarity. In the case of the right-cornered loudspeaker system, the angle between vertical finger 68 and horizontal finger 66 of the left-cornered loudspeaker system shown at FIG. 6 is of an opposite sign and equal magnitude.

A seventh angle 146 is the azimuth of principal plane 100 of left-cornered loudspeaker system 20 with respect to the principal plane of right-cornered loudspeaker system 144 and equal to 60°, The arrowhead of the radiation axis 122 of closed-back tweeter 48 that is a component of the left-cornered loudspeaker system points toward left side wall 137 of room 119. The arrowhead of the radiation axis of the tweeter that is a component of the right-cornered loudspeaker system points towards a right side wall 148 of the room. The arrowhead of each radiation axis indicates the direction of projecting sound. Thus the tweeters of the left-cornered and right-cornered loudspeaker systems are oppositely supported on baffle 70 of each system.

Listener 118 is ideally positioned in room 119 in close proximity to the intersection of first and second principal axis 100 of left-cornered loudspeaker system 20 and right-cornered loudspeaker system 144.

Theory of Operation—Interaural Level Difference Vs. Distance

According to the duplex theory of sound, low and high frequency sources of sound can be horizontally localized predominantly by respectively interaural phase difference or IPD and interaural sound pressure level difference or ILD. That is, IPD and ILD are the differences of respectively phase and level at a listener's ears that occur depending on the frequency of sound produced and the azimuth of the sound source. With the sound source directly in front of the listener, azimuth equals 0° and both IPD and ILD are equal to respectively 0° and 0 dB at any frequency.

One published authoritative study measured ILD as a function of frequency and azimuth where a sound source of pure tones was located 2 m from the center of the head of a listener. Frequency of the sound source made equal to 1 kHz and azimuth equal to 45° and 90° produced ILDs of respectively 5.0 dB and 6.0 dB. Frequency of the sound source made equal to 5 kHz and azimuth equal to 45° and 90° produced ILDs of respectively 9.0 dB and 12.0 dB.

A theoretical calculation of ILD with respect to frequency and azimuth by the physicist William M. Hartmann was published in 1999. ILD was calculated as the theoretical ratio of intensities of a plane wave of sound on opposite sides of a sphere that the plane wave is incident to. The front of a plane wave is that which would be produced by a point source of sound at an infinite distance from the point of incidence. Theoretical ILD for frequency equal to 1 kHz and azimuth equal to 45° and 90° was calculated as respectively 3.0 dB and 5.3 dB. Where frequency equaled 5 kHz, corresponding to azimuth equal to 45° and 90°, theoretical ILD equaled respectively 5.0 dB and 9.0 dB.

Comparing measured and theoretical ILD where incidence occurs at respectively 2 m and infinity from a point source of sound, measured ILD is several decibels higher. For frequency equal to 1 kHz and azimuth equal to 45° and 90°, ILD at 2 m (measured) with respect to ILD at infinity (theoretical) is greater by respectively 2.0 dB and 0.7 dB. For frequency equal to 5 kHz and azimuth equal to 45° and 90°, ILD at 2 m (measured) with respect to ILD at infinity (theoretical) is greater by respectively 4.0 dB and 3.0 dB. Irrespective of frequency, a change of ILD of about 0.5 dB is audible. Thus hypothetically a cue to the distance of a sound source from a listener within a range of less than about 10 m might be ILD approaching that of a point sound source at an infinite distance from the listener.

At frequencies of a sound source less than about 1 kHz, ILD is negligible and IPD for a given azimuth is constant irrespective of distance of the source from a listener greater than about 1 m. The above analysis suggests that ILD and not IPD can be an important cue to near distances. Thus in an effort to make the apparent distance to a sound source greater than the actual distance, there is no benefit to producing a virtual source of sound of frequencies less than about 1 kHz. That is, presumably sounds of a frequency produced by the source less than about 1 kHz don't provide a cue as to the distance of the source from the listener.

With respect to constant azimuth and distance of a sound source from the listener, a circle on a plane perpendicular to an axis through the ears of the listener and coincident with the location of the sound source defines the range of locations of the sound source where ILD is about constant. That is, the vertical component of the direction of propagation of a sound wave incident to the listener does not largely affect ILD. Thus it is also concluded that the reflective surface according to my loudspeaker system can be most economically vertically flat as ILD of sound projected off of the reflective surface toward the listener is affected by the curvature of the reflective surface horizontally only.

Given that azimuth of the sound source equals 0° or 180°, for any distance of the source from the listener, ILD equals 0. dB. Thus ILD can hypothetically be a cue to the distance of a source from a listener only when the source is positioned to one side of the listener.

While I maintain that the theory of operation according to my loudspeaker system given here is plausible, to date I do not consider it to be conclusively proven and thus I do not wish to be bound by this Operation—FIGS. 7 and 8—Virtual Center of Radiation Referring to FIG. 7 wherein the mirror equation of optics is applied to the method of my loudspeaker system for making the distance to virtual center of radiation 116 from vertex 96 equal to a few meters, $$I = \frac{RO}{2O - R}$$

where,

I=the distance from vertex 96 to virtual center of radiation 116 equals −2.0 m or −6.6 ft.

R=the distance from the vertex to radius center 94 equals 61 cm or 2 ft.

O=the distance from the vertex to first center of radiation 102 equals 26.5 cm or 10.4 inches Thus at FIG. 8, listener 118 can perceive the virtual center of radiation at a distance of about 2.0 m behind the location of the first center of radiation of closed-back tweeter 48 as being the location of the source of the sound projected by the closed-back tweeter. Apparent source distance I of a negative value indicates that the virtual center of radiation is located on the opposite side of concave reflective surface 38 to that of the (actual) first center of radiation.

It would be advantageous to reduce source distance O shown at FIG. 7 to less than 26.5 centimeters for two reasons. Firstly, referring to FIG. 1, reducing the extent to which retractable spacing mechanism 40 must protrude away from the front of left-cornered loudspeaker system 20 when the system is operated makes the system more compact. Secondly, it is known to the art of designing two-way loudspeaker systems that the distance between low and high frequency range loudspeakers of the system is preferably not more than equal to the wavelength of the crossover frequency of the system. Thereby, complexity of the radiation characteristic of the left-cornered loudspeaker system at frequencies near the crossover frequency of the system is minimized.

Where the mirror equation is expressed with radius of curvature R as the dependent variable, $$R = \frac{2OI}{O+I}$$

Given that $$|I| >> O$$

then, where virtual source distance I is a constant, radius of curvature R is directly proportional to source distance O.

There are three disadvantages to making radius of curvature R less than that of the preferred embodiment of my loudspeaker system equal to 61 cm or 24 inches. Referring to FIG. 8, aperture 62 cannot be made equal to less than about 25.4 cm or 10 inches without reducing the effectiveness of concave reflective surface 38 at reflecting sound of a frequency equal to and approaching the lower frequency of the operating frequency range of closed-back tweeter 48 or 2 kHz. Additionally, given a constant aperture, the radian measure encompassed by the concave reflective surface is inversely proportional to the radius of curvature. Thus a first disadvantage is a cylindrical concave reflective surface that is less shallow which has correspondingly increased aberration. For the purpose of eliminating such aberration, the concave reflective surface could be parabolic. However then the concave reflective surface made parabolic as opposed to circular further reduces the shallowness of the curvature of the surface. Thus a second disadvantage is thought to be the possibility of the formation of a resonant cavity as a result of a reflective surface of increased concavity and baffle 70 positioned closer to the concave reflective surface.

Referring to FIG. 8, a third disadvantage to making radius of curvature R equal to less than 61 centimeters is increased obstruction by baffle 70 of sound projected by closed-back tweeter 48 off of concave reflective surface 38 toward listener 118. So that sound projected by the closed-back tweeter is substantially hemispherical throughout the operating frequency range of the tweeter, it is necessary for the width of the baffle to equal 16.5 centimeters. According to the method of my loudspeaker system, first angle 128 is such that sound projected by the omni-directional closed-back tweeter at −90° with respect to radiation axis 122 represented by first sound ray 124 strikes the concave reflective surface at right side edge 92. Thus reducing the radius of curvature results in the baffle closer to the concave reflective surface and the component of the width of the baffle perpendicular to principal plane 100 together with the first angle is increased and causing greater obstruction by the baffle.

The focal ratio of concave reflective surface 38 equal to 1.2 would appear to be appropriate. However as this judgment is not grounded in extensive objective research, I don't wish to be bound by this.

At FIG. 8, listener 118 is located about 3.0 m or 9.8 ft. from vertex 96. As calculated for FIG. 7, virtual source distance I equal to the distance from the vertex to virtual center of radiation 116 equals 2.0 m. The virtual source distance is shown to scale at FIG. 7 and not to scale at FIG. 8. Thus presumably sound projected by closed-back tweeter 48 off of concave reflective surface 38 toward the listener as opposed to directly from the tweeter causes ILD to be reduced by an audible extent or greater than about 0.5 dB.

Operation—FIG. 8 and FIG. 9—Focusing of High Frequency Range Sound

Referring to FIG. 9, supposing that the position of the center of the head of listener 118 is moved from coincident with principal plane 100 to one side of the principal plane, the restriction is made that the center of the listener's head remains coincident with base line 140. Then the intersections of first reflected sound ray 108 and second reflected sound ray 110 with the base line represent the limits of that movement within which the listener perceives virtual center of radiation 116 as the apparent source location of the sound reflected to him/her off of concave reflective surface 38. Not shown at FIG. 9 and shown at FIG. 8 is the source of the sound projected off of the concave reflective surface to the listener, tweeter 48.

The relationship between the lengths of base line 140 and aperture 62 can be established by considering a first triangle and a second triangle. The first triangle has a base equal to the aperture and sides equal to first virtual ray 112 and second virtual ray 114. The second triangle has a base equal to the base line and sides equal to first reflected sound ray 108 extended by the first virtual ray and second reflected sound ray 110 extended by the second virtual ray. The height of the first triangle is very nearly equal to virtual source distance I. The height of the second triangle is equal to the sum of the virtual source distance and distance to listener L. As the first and second triangles are similar, the length of the base line with respect to that of the aperture is equal to the sum of the virtual source distance and the distance to listener times the aperture and divided by the virtual source distance.

Aperture 62 equals 25.4 cm or 10 inches. Virtual source distance I and distance to listener L equal respectively 2 m or 6.6 ft. and 3 m or 9.8 ft. Thus base line 140 equals 63.5 cm or 25 inches. Generally the distance between the center of the heads of first and second listeners seated side by side can be equal to 63.5 cm. Thus given a listening area about 3 m from my loudspeaker system, the maximum number of listeners that the preferred embodiment of my loudspeaker system can effectively accommodate is two.

Where virtual source distance I and distance to listener L are constants, then the base of the first triangle equal to aperture 62 results in the maximum length of base line 140. Accommodating as many listeners as possible effectively listening to my loudspeaker system is preferable. Thus according to the method of my loudspeaker system, as shown at FIG. 8, sound is projected by tweeter 48 off of concave reflective surface 38 from all points along the concavity of the concave reflective surface horizontally from left side edge 120 to right side edge 92.

Operation—FIGS. 3 and 8—Directionality of Sound Projected by Tweeter

Neglecting the dimensions of the faceplate of closed-back tweeter 48 of FIG. 8 including a dome-type radiator of diameter equal to 2.54 cm and not supported by baffle 70, the tweeter projects sound into 4-pi space or spherically given frequency of the sound less than about 13 kHz and into 2-pi space or with hemispherical directionality for frequency of the sound above about 13 kHz. Supporting the tweeter on the baffle extends the threshold of the projection of sound with a hemispherical directionality to spherical directionality from about 13 kHz to about 2 kHz. The threshold frequency is lowered because the dimensions of the baffle are comparable to wavelength corresponding to frequency equal to 2 kHz.

Referring to FIG. 8, the spherical projection of sound by closed-back tweeter 48 would allow such sound to arrive directly to listener 118. As the directly arriving sound would arrive almost simultaneously with the same sound projected by the tweeter off of concave reflective surface 38 toward the listener, the two arrivals would be heard as one or fused. The process of fusing would result in sound with two competing source locations, first center of radiation 102 and virtual center of radiation 116. Thereby, relative to the distance from the listener to the virtual center of radiation, the apparent distance to the source of the sound would be reduced and defeating the purpose of my loudspeaker system.

Referring to FIG. 3, the width of baffle 70 equals the dimension of minor axis 74 or 16.5 cm. Wavelength corresponding to the crossover frequency of 2 kHz of the preferred embodiment of my loudspeaker system is also equal to 16.5 cm. The height of the baffle equals the dimension of major axis 72 or 27.9 cm and thus is greater than the wavelength corresponding to the crossover frequency of 2 kHz. Thus the width and height of the baffle are such that closed-back tweeter 48 of FIG. 8 tends to produce a hemispherical radiation pattern at frequencies within the operating range of the closed-back tweeter. The width and height of the baffle of unequal dimensions is preferable for reducing ripple of the sound intensity as a function of frequency of the sound projected by the tweeter that accompanies wavelength of that sound approaching being comparable to the dimensions of the baffle.

Shown at FIG. 8, third sound ray 132 represents the direction of sound projected by the tweeter that most closely approaches arriving directly to listener 118. As the third sound ray is at a 180° angle with respect to the direction of first sound ray 124, third angle 134 is equal to first angle 128 or about 27°. With respect to principal plane 100, fourth angle 139 equals 30°. Thus with respect to the principal plane, the azimuth of the third sound ray is nearly equal to that of mid-sagittal plane 136 and none of the sound projected by closed-back tweeter 48 with hemispherical directionality to the left side of baffle 70 arrives directly to the listener.

Operation—FIG. 8—Obstruction of Reflections by Baffle

Sound projected by closed-back tweeter 48 and reflected off of concave reflective surface 38 in the vicinity of vertex 96 may be obstructed by baffle 70. Such obstruction is preferably minimized as it may reduce the intensity and/or may alter the azimuth of sound projected by the closed-back tweeter off of the concave reflective surface toward listener 118. Such obstruction occurs when the dimensions of the baffle are comparable to the wavelength of the sound reflected off of the concave reflective surface toward the baffle.

In the orthogonal top view of FIG. 8, the component of the width of baffle 70 that is perpendicular to principal plane 100 horizontally obstructs sound reflected off of concave reflective surface 38. The baffle is at a right angle to radiation axis 122 as is first sound ray 124. Thus the azimuth of the baffle with respect to the principal plane equals that of first angle 128 or about −27°. The component of the width of the baffle perpendicular to the principal plane equals the sine of the absolute value of the first angle or 27° times the width of the baffle, that is, about one-half times the width of the baffle.

Shown at FIG. 8, closed-back tweeter 48, which is necessarily of the omni-directional type and supported by baffle 70, is oriented according to the method of my loudspeaker system to cause first sound ray 124 at a right angle to radiation axis 122 directed towards right side edge 92 of concave reflective surface 38. Given that the ratio of the distance from vertex 96 to first center of radiation 102 with respect to the focal length of the concave reflective surface is fixed, then the azimuth of the flat surface of the baffle with respect to principal plane 100 is inversely proportional to the focal ratio of the concave reflective surface. It is thus further apparent that according to the method of my loudspeaker system, making the focal ratio of the concave reflective surface not less than about 1.2 advantageously minimizes horizontal obstruction by the baffle of sound projected by the tweeter off of the concave reflective surface toward listener 118.

As has been previously described, the width and height of baffle 70 of FIG. 3 are preferably of unequal dimensions wherein tweeter 48 of FIG. 8 is supported symmetrically on the baffle. The direction of sound in a vertical plane redirected by concave reflective surface 38 towards listener 118 of FIG. 8 does not alter ILD. Thus if obstruction of sound projected by the tweeter off of the concave reflective surface toward the listener by the baffle must be greater either vertically or horizontally, it is preferable that such obstruction is lessened horizontally.

Operation—FIG. 2 and FIG. 8—Imaging and Ambient Sound

Shown at FIG. 8, reflector 36 and tweeter 48 are positioned in room 119 at least one meter from rear wall 138 and left side wall 137 with first center of radiation 102 of the tweeter at ear level of listener 118. As a result, sound projected by the closed-back tweeter off of concave reflective surface 38 toward the listener travels the shortest distance of all of the sound projected by the tweeter and reflected toward the listener. Furthermore, sound projected by the closed-back tweeter off of the concave reflective surface to the listener is horizontally focused. Thus at the location of the listener, the sound with virtual center of radiation 116 arrives earliest and with the greatest intensity relative to the time of arrival and intensity of other sound projected by the tweeter. Thereby, virtual center of radiation 116 is established as the apparent location of the source of the sound projected by the tweeter.

Shown at FIG. 8, the absolute value of first angle 128 and second angle 130 both equal about 27°. In a horizontal plane, then, about one-third of the sound projected by tweeter 48 horizontally through 180° is reflected off of concave reflective surface 38 toward listener 118. Referring to FIG. 2, height 64 and aperture 62 of the concave reflective surface are of an equal dimension. Thus about one-sixth of the sound projected by the closed-back tweeter through 360° in a vertical plane is reflected from the concave reflective surface.

The percentage of sound projected directly to a listener relative to the total sound projected by a typical direct-radiating loudspeaker is about 70%. The percentage of sound projected by closed-back tweeter 48 off of concave reflective surface 38 toward listener 118 of FIG. 8 is considerably less than 70% of the total sound projected by the closed-back tweeter. Thereby, my loudspeaker system replacing a direct-radiating loudspeaker system in a room increases the apparent ambience of reproduction.

Operation—FIG. 10—Localization of Low and High Frequency Sound Sources

The ability of a listener to correctly judge the azimuth of a source of sound projecting sound in the low frequency range of 150 Hz to 1 kHz is about as good as such ability for sound in the high frequency range of 1 kHz to 20 kHz. If the apparent azimuths of the reproduction of low and high frequency sound of a musical instrument are unequal, then the desired distinct apparent localization of the instrument at a point in space can't occur.

A fifth angle 142 is the azimuth of the sound projected by low frequency range loudspeaker 32 with a second center of radiation 141 to the center of the head of listener 118 with respect to mid-sagittal plane 136 of the listener. Sixth angle 143 is the azimuth of the sound projected by tweeter 48 with virtual center of radiation 116 to the center of the head of the listener with respect to the mid-sagittal plane. For the listener positioned to either side of the principle plane, the difference of the measures of the fifth and sixth angles is on average minimized by the second center of radiation coincident with principal plane 100.

CONCLUSION, RAMIFICATIONS AND SCOPE

Thus the reader can see that my loudspeaker system reproducing a musical performance in a room in front of and to one side of a listener in the room gives the impression of the reproduction occurring disassociated from and at a considerable distance behind the location of my loudspeaker system. Additionally, more than 30% of the total high frequency range sound projected by the tweeter of my loudspeaker system is directed toward the boundaries of the room thereby adding an ambience effect to the reproduction. The end result is that reproduction of music by my loudspeaker system replicates a live performance to a degree that has not been previously possible.

The foregoing text and figures concern only the preferred embodiment of my loudspeaker system and provide many details making my loudspeaker system comprehensible by way of example. Thus the numerous specificities of the above description should not be interpreted as limiting the scope of my loudspeaker system. Possible variations of my loudspeaker system may include but are not limited to the following.

a) The crossover frequency or the lower cut-off frequency of the closed-back tweeter projecting sound toward the concave reflective surface can be in the range of about 1 kHz to 3 kHz.

b) The perimeter of the flat baffle supporting the closed-back tweeter in front of the concave reflective surface may be of a shape other than elliptical such as circular, rhomboid, triangular, etc.

c) Spherical projection of sound by the closed-back tweeter might possibly be prevented by means other than supporting the tweeter on a baffle such as the closed-back tweeter including a horn or wave-guide.

d) Means for supporting the closed-back tweeter at a distance in front of the reflective surface can be fixed. Retractable means for supporting the closed-back tweeter can take many different forms other than that of the preferred embodiment such as telescoping, swiveling and/or pivoting mechanisms, a hinged stanchion that can be latched in an upright position, etc.

e) The reflective surface can include a curvature horizontally that is parabolic and further include a focal ratio that is less than unity.

f) The reflective surface including a shallow concavity of less than about 2.5 cm maximum concavity may be embedded, routed, or formed into one end of the exterior surface of a one piece vertical panel at the front of the cabinet of my loudspeaker system. The remaining surface area of the panel may support one or more low frequency range loudspeakers.

g) The aperture of the horizontal concavity of the concave reflective surface can be greater than about 1.5 times the wavelength of the lower limit of high frequency range reproduction by the tweeter or the crossover frequency.

Accordingly, the scope of my loudspeaker system should be determined not by the preferred embodiment illustrated, but by the appended claims and their legal equivalents.

I claim:

1. A loudspeaker system comprising:

a. a reflector having a concave reflective surface, said concave reflective surface substantially formed by vertical and parallel first and second sides of a rectangle wherein said first side is rotated around said second side as axis, b. a first loudspeaker positioned in front of and projecting sound above a crossover frequency toward said concave reflective surface and the center of radiation of said first loudspeaker very nearly lies on a principle plane of said concave reflective surface at a perpendicular distance from the vertex of the concavity of said reflective surface equal to less than one-half times the radius of curvature of said concave reflective surface, c. a second loudspeaker positioned to project sound below said crossover frequency substantially in the direction horizontally of said principal plane and the center of radiation of said second loudspeaker very nearly lies on said principal plane, and d. means for supporting said first and second loudspeakers relative to said reflector, e. whereby, said loudspeaker system positioned to a side of a listener can cause said listener to localize the virtual source of sound projected by said first loudspeaker at a distance of a few meters behind said loudspeaker system.

2. The loudspeaker system of claim 1 wherein the aperture of said concave reflective surface minimally equals about 1.5 times the wavelength of said crossover frequency.

3. The loudspeaker system of claim 1 wherein said radius of curvature equals about two to three times said aperture.

4. The loudspeaker system of claim 1 wherein said crossover frequency is not less than about 1 kHz.

5. The crossover frequency of claim 4 wherein said crossover frequency equals about 2 kHz, whereby said loudspeaker system is more compact compared to the size of said loudspeaker system corresponding to said crossover frequency equal to 1 kHz, and the improvement to the spatial quality of reproduction effected by said loudspeaker system is relatively unimpaired.

6. The loudspeaker system of claim 1 wherein the center of radiation of said second loudspeaker is generally on a vertical line coincident with the vertex of the concavity of said reflective surface, whereby complexity of interference of the sound projected by said first loudspeaker and reflected off of said concave reflective surface and by said second loudspeaker is beneficially minimized.

7. The loudspeaker system of claim 1 further including means for containing sound projected to the rear of said first loudspeaker.

8. The first loudspeaker of claim 7 further including supporting said first loudspeaker on a baffle.

9. The first loudspeaker of claim 8 wherein the front surface of said baffle orthogonal to the radiation axis of said first loudspeaker is positioned in a manner causing a line lying on the front surface of said baffle to intersect with an edge of said concave reflective surface that said baffle is slanted towards, whereby obstruction by said baffle of sound projected off of said concave reflective surface is minimized.

10. The loudspeaker system of claim 1 wherein said means for supporting is implemented making available a first positioning of said first loudspeaker relative to said reflector that allows proper operational functioning of said loudspeaker system and a second retracted positioning of said first loudspeaker making said loudspeaker system more compact and less prone to damage when not in use.

11. A method of directing and focusing sound projected by a loudspeaker system, comprising the steps of:

a. providing a reflector having a concave reflective surface, said concave reflective surface substantially formed by vertical and parallel first and second sides of a rectangle wherein said first side is rotated around said second side as axis, b. projecting sound above a crossover frequency with substantially hemispherical directionality and horizontally in a direction obliquely toward said concave reflective surface and away from a listener by a first loudspeaker having a center of radiation very nearly coincident with a principle plane of said concave reflective surface, c. projecting sound below said crossover frequency generally toward said listener by a second loudspeaker having a center of radiation very nearly coincident with said principal plane, d. reflecting a portion of the sound projected from said first loudspeaker off of said concave reflective surface toward said listener, e. positioning the center of radiation of said first loudspeaker at a distance from the vertex of the concavity of said reflective surface causing sound projected by said first loudspeaker and reflected off of said concavity to diverge from said principle plane, and f. supporting said first and second loudspeakers relative to said reflector, g. whereby, said loudspeaker system positioned to a side of said listener can cause said listener to localize the virtual source of sound projected by said first loudspeaker at an approximate distance of a few meters behind said loudspeaker system.

12. The method of claim 11 further including selecting an aperture of the concavity of said concave reflective surface that preserves most of the intensity of a portion of the sound of a frequency not less than said crossover frequency projected from said first loudspeaker and reflected off of said concave reflective surface,

13. The method of claim 11 further including selecting a radius of curvature of said concave reflective surface equal to about two to three times said aperture.

14. The method of claim 11 further including making said crossover frequency equal to greater than about 1 kHz.

15. The method of claim 14 wherein said crossover frequency is made equal to 2 kHz, whereby said loudspeaker system is more compact compared to the size of said loudspeaker system corresponding to said crossover frequency equal to 1 kHz, and the improvement to the spatial quality of reproduction effected by said loudspeaker system is relatively unimpaired.

16. The method of claim 11 further including positioning the center of radiation of said second loudspeaker generally on a vertical line coincident with the vertex of the concavity of said reflective surface.

17. The method of claim 11 wherein hemispherical radiation of said first loudspeaker is accomplished by containing sound projected to the rear of said first loudspeaker.

18. The method of claim 17 further including mounting said first loudspeaker on a baffle.

19. The method of claim 18 further including horizontally slanting said baffle resulting in a line lying on the front surface of said baffle intersecting with a vertical edge of said concave reflective surface that said baffle is slanted towards, whereby obstruction by said baffle of sound projected off of said concave reflective surface is minimized.

20. The method of claim 11 wherein positioning of the center of radiation of said first loudspeaker is at a perpendicular distance from the vertex of the concavity of said reflective surface causing the sound projected by said first loudspeaker off of the concavity of said reflective surface to diverge from said principal plane by less than about 10°.

* * * * *